US005464319A

United States Patent [19]

Liskow

[11] Patent Number: 5,464,319

[45] Date of Patent: Nov. 7, 1995

[54] REGENERATIVE PUMP WITH AN AXIALLY SHIFTING WORKING FLUID CHAMBER

[75] Inventor: Uwe Liskow, Seoul, Rep. of Korea

[73] Assignee: Robert Bosch GmbH, Stuttgart, Germany

[21] Appl. No.: 277,904

[22] Filed: Jul. 20, 1994

[30] Foreign Application Priority Data

Aug. 6, 1993 [DE] Germany ..... 43 26 505.7

[51] Int. Cl.[6] ..... F04D 5/00

[52] U.S. Cl. ..... 415/55.1; 415/55.3

[58] Field of Search ..... 415/55.1, 55.2, 415/55.3, 55.4

[56] References Cited

U.S. PATENT DOCUMENTS 5,160,249 11/1992 Iwai et al. ..... 415/55.3
5,215,429 6/1993 Sun ..... 415/55.4 X
5,336,045 8/1994 Koyama et al. ..... 415/55.1 X
5,338,165 8/1994 Brockner et al. ..... 415/55.1

*Primary Examiner*—Edward K. Look
*Assistant Examiner*—Michael S. Lee
*Attorney, Agent, or Firm*—Michael J. Striker

[57] ABSTRACT

In a peripheral pump with an impeller with a plurality of vanes and a pump chamber, the impeller has a ring-shaped supply passage in each limiting wall, and supply passages are connected over a periphery of the impeller. A suction opening is formed in one wall part, and the front supply passage is formed in this wall part separately from the suction opening and after the suction opening in a rotary direction of the impeller. The rear supply passage is formed in the other wall part and is formed in the peripheral region of the suction opening. During the operation fuel flows through the suction opening only into the rear supply passage, and in the rotary direction first after the suction opening flows from the rear supply passage which has a reduced cross-section, into the front supply passage which has an increased cross-section.

8 Claims, 2 Drawing Sheets

Fig. 3
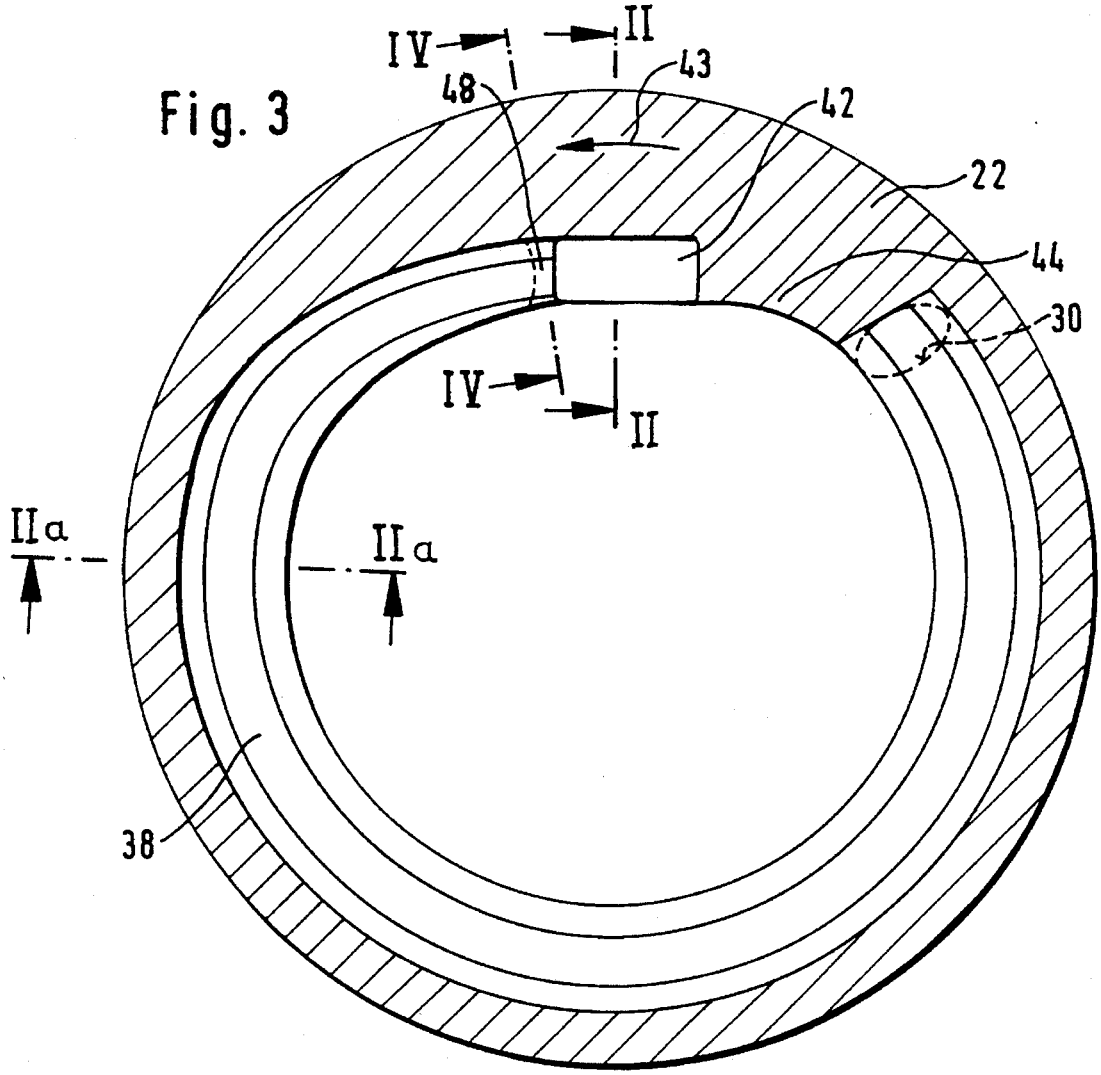
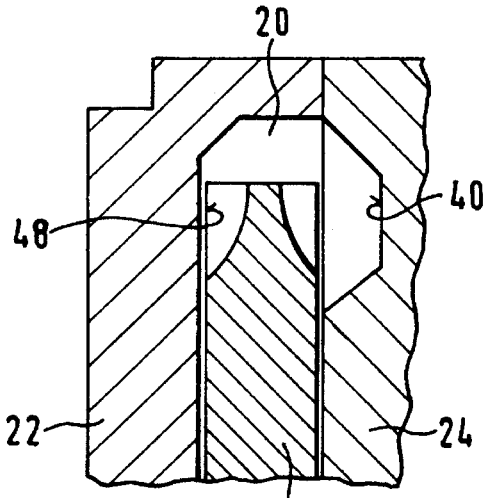
Fig. 4
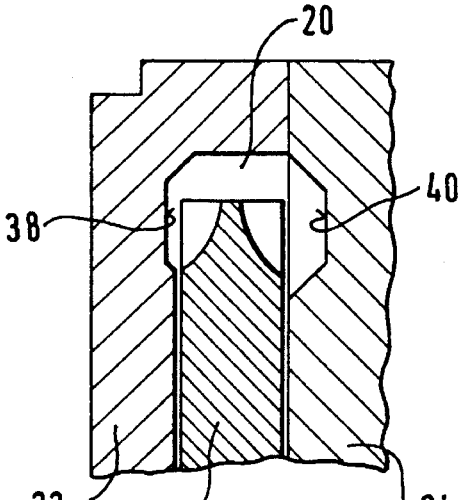
Fig. 5

REGENERATIVE PUMP WITH AN AXIALLY SHIFTING WORKING FLUID CHAMBER

BACKGROUND OF THE INVENTION

The present invention relates to a peripheral pump for feeding fuel from a supply tank to an internal combustion of a motor vehicle.

More particularly, it relates to such a peripheral pump which has an impeller provided with a plurality of vanes and rotatable in a pump chamber limited by walls provided with supply passages.

Peripheral pumps of the above mentioned general type are known in the art. One of such peripheral pumps is disclosed for example in the German document DE 40 36 309 A1. The peripheral pump operates for feeding fuel from a supply tank to an internal combustion engine of a motor vehicle and has an impeller with vanes distributed over its both end surfaces. The pump chamber in which the impeller rotates is limited in direction of the rotary axis of the impeller by a wall part and in radial direction by a housing part. End sides of both wall parts which face the impeller are provided with a substantially ring-shaped supply passage, and both supply passages extend radially outwardly farther than the impeller and connected with one another over the outer periphery of the impeller. A suction opening is formed in one wall part and opens in the supply passages formed in this wall part identified as a front supply passage. The front supply passage is formed as a full passage in the region of the suction opening. The other wall part is provided with a pressure opening which leads from the supply passage formed in this other wall part outwardly and identified as a rear supply passage. The supply passages have a trapezoidal cross-section and an overflow connection of the rear supply passage with the suction opening is provided in the region of the suction opening. The overflow connection is limited outwardly by a wall extending substantially parallel to the rotary axis of the impeller and also limited with respect to the suction opening by a wall which is inclined to the rotary axis. The transition of the parallel wall to the inclined wall is arranged near the end side of the impeller which faces the suction opening, as considered in direction of the rotary axis of the impeller.

In the region of the suction opening fuel flows both in the front passage formed in the wall part which faces the suction opening, and also through the overflow connection over the periphery of the impeller, into the rear supply passage formed in the other wall part. The fuel which flows into the supply passages is displaced by the impeller to form whirls, and fuel flows from the rear supply passage back to the suction opening and into the front supply passage. Moreover, during inflow of the fuel into the supply passages, the arrangement of the inclined wall of the overflow region forms whirls, so that the fuel does not flow into the rear supply passage but instead flows again back to the suction opening or to the front supply passage. Thereby the efficiency of the peripheral pump is reduced.

SUMMARY OF THE INVENTION

Accordingly, it is an object of the present invention to provide a peripheral pump which avoids the disadvantages of the prior art.

In keeping with these objects and with others which will become apparent hereinafter, one feature of the present invention resides, briefly stated, in a peripheral pump in which the front passage arranged in the wall part which faces the suction opening is first formed after the suction opening with a full cross-section as considered in the rotary direction of the impeller, the rear supply passage arranged in the wall part which does not face the suction opening is formed in the region of the suction opening and the cross-section of the rear supply passage reduces in the rotary direction after the suction opening.

When the peripheral pump is designed in accordance with the present invention, it eliminates the disadvantages of the prior art and provides for the highly advantageous results. In such a peripheral pump the inflow of the fuel into the supply passages and thereby the efficiency of the peripheral pump is improved. In the region of the suction opening, first only the rear supply passage formed in the wall which does not face the suction opening is first filled, since the front supply passage in the wall part facing the suction opening is formed in the rotary direction of the impeller after the suction opening and therefore no fuel can directly flow into it from the suction opening. The front supply passage is formed in the rotary direction after the suction opening in the wall part facing the suction opening, and fuel flows from the rear supply passage whose cross-section is reduced into the front supply passage.

In accordance with another feature of the present invention, an inflow region is formed in the rear supply passage in the peripheral region of the suction opening. It is limited radially outwardly toward the rear supply passage by a wall extending substantially parallel to the rotary axis of the impeller, and limited with respect to the suction opening by a wall which is inclined from the above mentioned parallel wall to the rotary axis. The transition between both walls as considered in direction of the rotary axis is formed at the height of the radial outlet of the vanes of the impeller at the end side facing the suction opening, or arranged closer to the rear supply passage. When the pump is designed in accordance with these features, the formation of whirls is substantially reduced in the overflow region and thereby a favorable inflow of the fuel in the rear supply passage is provided so that the efficiency of the peripheral pump is further improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view showing a peripheral pump in a section taken along the line III—III in FIG. 2;

FIG. 4 is a view showing a peripheral pump in accordance with the present invention in a section taken along the line IV—IV in FIG. 3 of a first embodiment; and FIG. 5 is a view showing a peripheral pump in accordance with the present invention in a section taken along the line IV—IV of a second embodiment.

DESCRIPTION OF THE PREFERRED EMBODIMENTS

Figure 1:
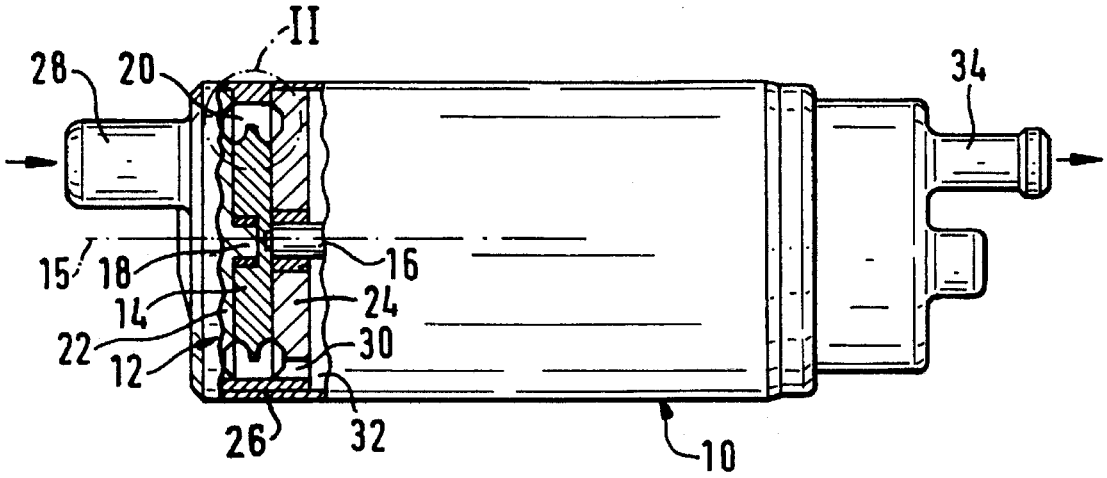
FIG. 1 is a view showing a fuel feeding aggregate with a peripheral pump in accordance with the present invention, in a longitudinal section.

An aggregate 10 shown in FIG. 1 operates for feeding fuel from a not shown supply tank to a not shown internal combustion engine of a motor vehicle. The fuel feeding aggregate 10 has a flow pump 12 with an impeller 14 which is connected with a shaft 16 of a not shown electric motor for joint rotation therewith. The impeller 14 is supported on a bearing pin 18 and arranged in a so-called pump chamber 20 which is limited by wall parts 22 and 24 as considered in direction of the rotary axis 15 of the impeller 14. In the radial direction the pump chamber 20 is limited by a cylindrical housing part 26 which can be formed of one piece with one of the wall parts 22 and 24. The bearing pin is arranged in the wall part 22. The other wall part 24 has a bearing point for the drive shaft 16. During the operation of the fuel feeding aggregate the flow pump 12 aspirates fuel through a suction pipe 28 and pumps it through a pump outlet 30 in the wall part 24 to a chamber 32 in which the not shown electric motor is accommodated. From there the fuel is supplied through an outlet or pump pipe 34 to the internal combustion engine.

Figure 2:
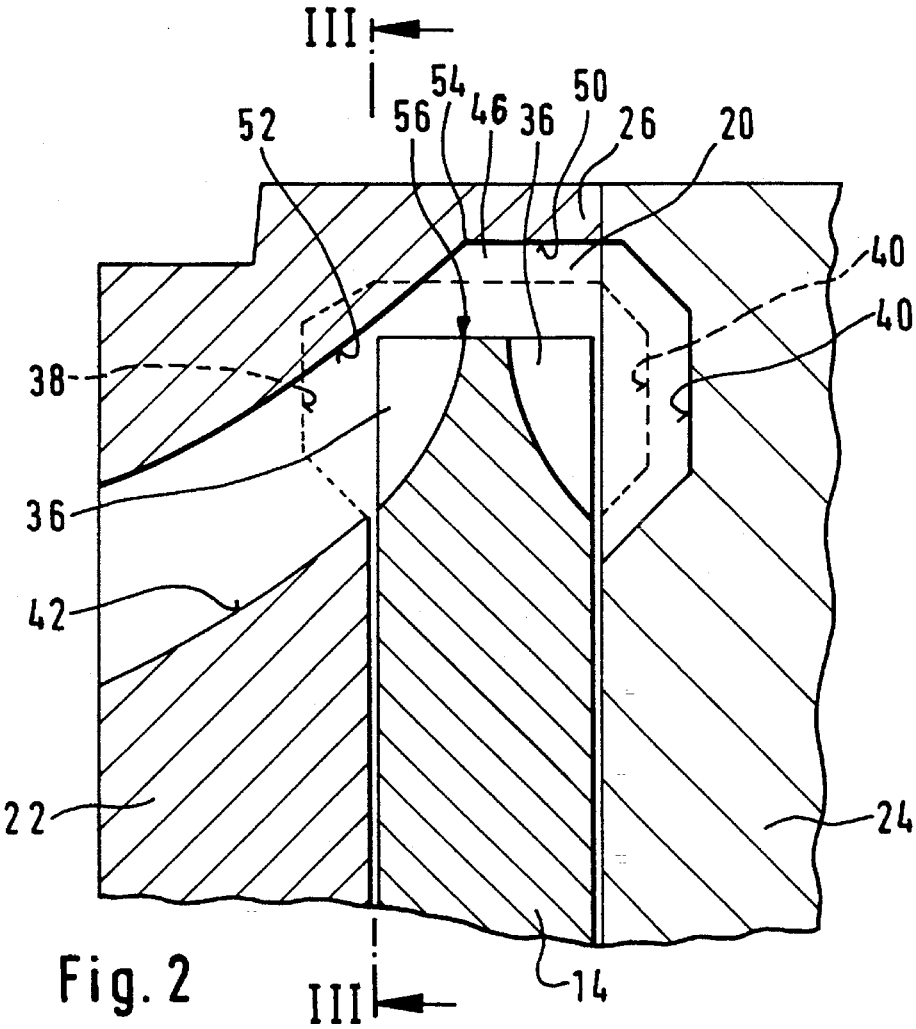
FIG. 2 is a view showing a portion II of the peripheral pump of FIG. 1 on an enlarged scale, with a section taken through the peripheral pump along the line II—II in FIG. 3.

The flow pump 12 is formed as a peripheral or side passage pump in which the impeller 14 is provided with vanes 36 arranged at both end sides and distributed over its periphery. Ring shaped supply passages 38 and 40 shown in FIG. 2 are provided in end surfaces of the wall parts 22 and 24 which face the impeller 14. The supply passages are arranged substantially at the same distance from the rotary axis 15 of the impeller 14 as the vanes 36. A suction opening 42 is provided in the wall parts 22 in which the supply passage 38 is formed and communicates with the suction opening 28. The supply passage 38 formed in the wall part 22 is subsequently identified as a front supply passage since it is located upstream as considered in the feeding region of the peripheral pump. A pump outlet 30 is formed in the other wall part 24 in which the other supply passage 40 is formed and identified as a pressure opening. The supply passage 40 formed in the wall part 24 is subsequently identified as a rear supply passage since it is located downstream as considered in the feeding direction of the peripheral pump.

The suction opening 42 is arranged at one end of the supply passages 38, 40 as considered in the rotary direction (arrow 43 in FIG. 3) of the impeller 14, while the pressure opening 30 is arranged at the other end. An interrupter 44 is formed between the suction opening 42 and the pressure opening 30 as shown in FIG. 3. In other words, the supply passages 38, 40 are not formed there and therefore fuel cannot flow from the pressure side of the flow pump 12 to the suction side. The supply passages 38, 40 have a trapezoidal cross-section as shown in FIG. 2 or in other words they have a trapezoidal shape in the section through the passages parallel to the rotary axis 15 of the impeller. However, they can have a different shape as well, for example, they can be rectangular or round. The supply passages 38, 40 extend radially outwardly farther than the impeller 14, and the cylindrical housing part 26 in the region of the supply passages 38, 40 has a distance from the outer peripheral impeller 14 so that both supply passages 38, 40 are connected with one another over the periphery of the impeller 14. In the region of the interrupter 44 the radial distance between the outer periphery of the impeller 14 and the cylindrical housing part 26 is small, for preventing a return flow of fuel from the suction side.

An inflow region 46 shown in FIG. 2 is formed in the peripheral region of the suction opening 42. The fuel can flow through the inflow region 46 from the suction opening 42 into the supply passage 40 formed in the wall part 24 which does not face the suction opening. The front supply passage 38 in the wall part 22 which faces the suction opening 42 is formed immediately after forwardly of the suction opening 42 as considered in the rotary direction 43 of the impeller 14 and separately from the suction opening 42. The separation between the front supply passage 38 and the suction opening 42 can be formed, as shown in FIG. 4, by an interrupter 48, so that no direct connection of the front supply passage 38 with the suction opening 42 is provided. It is also possible to substantially reduce the cross-section of the supply passage 38 toward the suction opening 42 as shown in FIG. 5, and thereby to form a separation between this passage and the suction opening 42. In the rotary direction 42 of the impeller 14, the cross-section of the front supply passage 38 increases usually after the suction opening 42 continuously or in steps and then remains substantially constant up to the pressure opening 30. The cross-section of the rear supply passage 40 in the peripheral region of the suction opening 42 or in other words in the inflow region 46 is greater than the remaining peripheral region and reduces usually in the rotary direction after the suction opening 42 and then remains substantially constant up to the pressure opening 30. The total cross-section of the front supply passage 38 and the rear supply passage 40 in the rotary direction of the impeller 14 after their cross-section increase or reduction is substantially identical, so that in both supply passages 38 and 40 the same fuel volume is supplied. In FIG. 2 the supply passages 38, 40 are shown additionally in a broken line in their constant cross-section in the rotary direction 43 after the suction opening 42. in section taken along the line IIa—IIa in FIG. 3.

During the operation of the fuel feeding aggregate the fuel flows through the supply passages 38 and 40 formed as described hereinabove through the suction opening 42 from the supply tank only into the rear supply passage 40 formed in the wall part which does not face the suction opening 42, since only this supply passage is formed in the peripheral region of the suction opening 42. The fuel which flows into the rear supply passage 40 is displaced by the vanes 36 of the impeller 14 in the rotary direction 43 of the impeller 14. Since the cross-section of the rear supply passage 40 is reduced in the rotary direction 43 of the impeller 14 after the suction opening 42 and the cross-section of the front supply passage 38 is increased, fuel flows in the rotary direction after the suction opening 42 from the rear supply passage 40 into the front supply passage 38. A return flow of fuel from the suction opening 42 is avoided due to the separation of the front supply passage 38 from the suction opening 42. Fuel is discharged through the pressure opening 30 at the pressure-side end of the rear supply passage 40 and the front supply passage 38 and then flows through the chamber 32 and the pressure pipe 34 to the internal combustion engine.

The inflow region 46 is formed in the peripheral region of the suction opening 42 so that it merges into the rear supply passage 40. The inflow region 46 is limited radially outwardly to the rear supply passage 40 by a wall 50 which extends substantially parallel to the rotary axis 15 of the impeller 14 and is formed on the cylindrical housing part 26. The inflow region 48 is limited radially outwardly toward the suction opening 42 by a wall 52 which is inclined to the rotary axis 15 and continuously merges into the suction opening 42. The transition 54 between the substantially parallel wall 50 and the inclined wall 52 as considered in direction of the rotary axis 15 of the impeller 14 is arranged substantially at the height of the radial outlet 56 of the vanes 36 of the impeller 14, which is formed at the end side of the impeller 14 facing the suction opening 42, or is arranged closer to the rear supply passage 40. Due to this construction of the overflow region 46, a whirl formation is avoided which otherwise would lead to a return flow of the fuel to the suction opening 42. Therefore a favorable inflow of the fuel from the suction opening 42 into the rear supply passage 40 is provided.

It will be understood that each of the elements described above, or two or more together, may also find a useful application in other types of constructions differing from the types described above.

While the invention has been illustrated and described as embodied in a peripheral pump for feeding fuel from supply tank to internal combustion engine of motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A peripheral pump for supplying fuel from a supply tank to an internal combustion engine of a motor vehicle, the peripheral pump comprising an impeller having end sides and being provided with a plurality of vanes which are arranged on said end sides and distributed over a periphery of said impeller; means forming a pump chamber in which said impeller rotates around a rotary axis, said means including two wall parts which limit said pump chamber in direction of said rotary axis and a housing part which limits said pump chamber in a radial direction, each of said wall parts being provided with a substantially ring-shaped supply passage and said supply passages are connected with one another over a periphery of said impeller, one of said wall parts being provided with a suction opening while the other of said wall parts is provided with a pressure opening, one of said supply passages which is arranged in the wall part being provided with said suction opening being a front supply passage with a full cross-section and formed exclusively downstream of said suction opening as considered in a rotary direction of said impeller, the other of said supply passages which is arranged in the wall part being provided with said pressure opening being a rear supply passage and formed in the region of said suction opening, and said rear supply passage has a cross-section which considered in said rotary direction decreases after said suction opening, so that fuel in the region of said suction opening flows substantially exclusively into said rear supply passage and in the rotary direction after said suction opening fuel flows from the rear supply passage into said front supply passage.

2. A peripheral pump as defined in claim 1; and further comprising an interrupter which separates said front supply passage from said suction opening.

3. A peripheral pump as defined in claim 1, wherein said supply passages have cross-sections which considered in said rotary direction of said impeller are equal after said suction opening.

4. A peripheral pump as defined in claim 3, wherein said cross-sections of said supply passages are vaiable over a first part of the periphery of said supply passages in the region of said suction opening and are constant over the remaining part of the periphery of said supply pasages.

5. A peripheral pump as defined in claim 1; and further comprising means forming in a peripheral region of said suction opening an inflow region into said rear supply passage, said means including a wall which extends substantially parallel to said rotary axis of said impeller and limits said inflow region radially outwardly toward said rear supply passage, and also including a wall which is inclined to said substantially parallel wall toward said rotary axis and limits said inflow region relative to said suction opening, and a transition formed between said substantially parallel wall and said inclined wall and located along said rotary axis in the region of a radial outer end of said vanes of said impeller formed at an end side facing said suction opening.

6. A peripheral pump as defined in claim 1, wherein said cross-section of said rear supply passage considered in said rotary direction decreases in an axial direction after said suction opening while said front supply passage has a cross-section which considered in said rotary direction increases in the axial direction after said suction opening so that a total cross-section of said front and rear supply passages remains identical.

7. A peripheral pump for supplying fuel from a supply tank to an internal combustion engine of a motor vehicle, the peripheral pump comprising an impeller having end sides and being provided with a plurality of vanes which are arranged on said end sides and distributed over a periphery of said impeller; means forming a pump chamber in which said impeller rotates around a rotary axis, said means including two wall parts which limit said pump chamber in direction of said rotary axis and a housing part which limits said pump chamber in a radial direction, each of said wall parts being provided with a substantially ring-shaped supply passage and said supply passages are connected with one another over a periphery of said impeller, one of said wall parts being provided with a suction opening while the other of said wall parts is provided with a pressure opening, one of said supply passages which is arranged in the wall part being provided with said suction opening being a supply passage with a full cross-section and formed exclusively after said suction opening as considered in a rotary direction of said impeller, the other of said supply passages which is arranged in the wall part being provided with said pressure opening being a rear supply passage and formed in the region of said suction opening, and said rear supply passage has a cross-section which considered in said rotary direction decreases after said suction opening, said front supply passage having a cross-section which is variable over the periphery of said front supply passage, said cross-section decreasing toward said suction opening in a direction opposite to said rotation direction of said impeller.

8. A peripheral pump for supplying fuel from a supply tank to an internal combustion engine of a motor vehicle, the peripheral pump comprising an impeller having end sides and being provided with a plurality of vanes which are arranged on said end sides and distributed over a periphery of said impeller; means forming a pump chamber in which said impeller rotates around a rotary axis, said means including two wall parts which limit said pump chamber in direction of said rotary axis and a housing part which limits said pump chamber in a radial direction, each of said wall parts being provided with a substantially ring-shaped supply passage and said supply passages are connected with one another over a periphery of said impeller, one of said wall parts being provided with a suction opening while the other of said wall parts is provided with a pressure opening, one of said supply passages which is arranged in the wall part being provided with said suction opening being a supply passage with a full cross-section and formed exclusively after said suction opening as considered in a rotary direction of said impeller, the other of said supply passages which is arranged in the wall part being provided with said pressure opening being a rear supply passage and formed in the region of said suction opening, and said rear supply passage has a cross-section which considered in said rotary direction decreases after said suction opening; and means forming in a peripheral region of said suction opening an inflow region into said rear supply passage, said means including a wall which extends substantially parallel to said rotary axis of said impeller and limits said inflow region radially outwardly toward said rear supply passage, and also including a wall which is inclined to said substantially parallel wall toward said rotary axis and limits said inflow region relative to said suction opening, and a transition between said substantially parallel wall and said inclined wall which when considered in direction along said rotary axis is located closer to said rear supply passage than a radial outlet of said vanes of said impeller formed at an end side facing said suction opening.

* * * * *